US010822912B2

(12) United States Patent
Kendall et al.

(10) Patent No.: US 10,822,912 B2
(45) Date of Patent: Nov. 3, 2020

(54) MULTI-LAYER PACKER BACKUP RING WITH CLOSED EXTRUSION GAPS

(71) Applicant: Baker Hughes, a GE company, LLC, Houston, TX (US)

(72) Inventors: Alexander M. Kendall, Houston, TX (US); Guijun Deng, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/521,307

(22) Filed: Jul. 24, 2019

(65) Prior Publication Data

US 2019/0345791 A1 Nov. 14, 2019

Related U.S. Application Data

(63) Continuation of application No. 15/701,015, filed on Sep. 11, 2017, now Pat. No. 10,689,942.

(51) Int. Cl.
*E21B 33/128* (2006.01)
*E21B 33/12* (2006.01)

(52) U.S. Cl.
CPC ..... *E21B 33/128* (2013.01); *E21B 33/1216* (2013.01)

(58) Field of Classification Search
CPC ..... E21B 33/128
See application file for complete search history.

(56) References Cited

U.S. PATENT DOCUMENTS

| | | | |
|---|---|---|---|
| 2,726,722 | A | 12/1955 | Baker |
| 2,767,795 | A | 10/1956 | Bush |
| 2,797,759 | A | 7/1957 | Long et al. |
| 2,885,009 | A | 5/1959 | Baker |
| 2,921,633 | A | 1/1960 | Baker |

(Continued)

FOREIGN PATENT DOCUMENTS

| | | | |
|---|---|---|---|
| AU | 2015397127 | B2 | 12/2016 |
| EP | 1197632 | A2 | 4/2002 |

(Continued)

OTHER PUBLICATIONS

Notification of Transmittal of the International Search Report; PCT/US2018/050395; dated Jan. 2, 2019; 5 pages.

(Continued)

*Primary Examiner* — Shane Bomar
(74) *Attorney, Agent, or Firm* — Cantor Colburn LLP

(57) ABSTRACT

An extrusion ring has a base from which multiple segmented rows of rings integrally extend. Gaps in one row are offset from the adjacent row to cover any gaps. The rows gain strength from a common base that also prevents relative rotation among the rows. The overlapping rings are additively manufactured with breakable restraints in some or all the gaps that fail during the setting such as in shear. Faster running in rates can be realized as each ring row has hoop strength due to the ties in the gap or gaps that are incorporated into the additive manufacturing process to make the assembly. Residual stresses in each ring from the additive manufacturing process are resisted from the ties in the gaps. Ties between overlapping rows are also contemplated.

13 Claims, 10 Drawing Sheets

(56) References Cited

U.S. PATENT DOCUMENTS 2,945,541 A 7/1960 Maly et al.
3,229,767 A 1/1966 Carter
3,298,440 A 1/1967 Current
3,313,553 A 4/1967 Gastineau
3,343,607 A 9/1967 Current
3,358,766 A 12/1967 Current
3,381,969 A 5/1968 Crow et al.
3,385,679 A 5/1968 Current
3,481,611 A 12/1969 Stratton
3,517,742 A 6/1970 Williams
3,960,311 A 6/1976 Griffiths
4,204,690 A 5/1980 Holland et al.
4,349,204 A 9/1982 Malone
RE31,933 E 7/1985 Taylor et al.
4,665,978 A 5/1987 Luke
4,753,444 A 6/1988 Jackson et al.
4,765,404 A 8/1988 Bailey et al.
4,852,394 A 8/1989 Lazes
4,892,144 A 1/1990 Coone
4,910,832 A 3/1990 Schaub et al.
5,027,894 A 7/1991 Coone et al.
5,161,806 A 11/1992 Balsells
5,311,938 A 5/1994 Hendrickson et al.
5,678,635 A 10/1997 Dunlap et al.
6,318,482 B1 11/2001 Fidtje
6,431,274 B1 7/2002 Tedham et al.
6,513,600 B2 2/2003 Ross
6,581,682 B1 6/2003 Parent et al.
6,598,672 B2 * 7/2003 Bell ..... E21B 33/1216 166/118
7,124,826 B2 10/2006 Simpson
7,178,601 B2 2/2007 Burge
7,273,110 B2 9/2007 Pedersen et al.
7,306,034 B2 12/2007 Garcia
7,341,110 B2 3/2008 Doane et al.
7,665,516 B2 2/2010 Roberts et al.
7,708,080 B2 5/2010 Conaway et al.
7,780,399 B1 8/2010 Garrison
8,151,873 B1 * 4/2012 Lee ..... E21B 33/1208 166/118
8,151,894 B2 * 4/2012 Nutley ..... E21B 17/10 166/380
8,205,671 B1 6/2012 Branton
8,276,678 B2 10/2012 Burnett et al.
8,327,929 B2 12/2012 Reid et al.
8,403,036 B2 3/2013 Neer et al.
8,469,088 B2 6/2013 Shkurti et al.
8,479,809 B2 7/2013 Farquhar
8,662,161 B2 3/2014 Lee et al.
8,701,787 B2 4/2014 Shkurti et al.
8,839,874 B2 9/2014 Bishop et al.
9,140,094 B2 9/2015 Lee et al.
9,194,206 B2 11/2015 Xu et al.
9,260,936 B1 2/2016 Branton
9,587,458 B2 * 3/2017 Derby ..... E21B 33/1216
9,845,658 B1 12/2017 Nish et al.
10,087,704 B2 10/2018 Conner et al.
10,435,972 B2 10/2019 Crump et al.
2002/0043368 A1 4/2002 Bell et al.
2003/0037932 A1 3/2003 Guillory et al.
2003/0226659 A1 12/2003 Smith et al.
2004/0134659 A1 7/2004 Hoffman et al.
2004/0150165 A1 8/2004 Grondahl et al.
2005/0189103 A1 9/2005 Roberts et al.
2006/0289173 A1 12/2006 Conaway et al.
2007/0125532 A1 6/2007 Murray et al.
2007/0200299 A1 8/2007 Kunz
2007/0256827 A1 11/2007 Guerrero et al.
2007/0261863 A1 11/2007 MacLeod et al.
2008/0041583 A1 2/2008 Angman et al.
2008/0060821 A1 3/2008 Smith et al.
2008/0061510 A1 3/2008 Li et al.
2008/0135240 A1 6/2008 Brennan et al.
2008/0190600 A1 8/2008 Shkurti et al.
2009/0065191 A1 3/2009 Reid et al.
2009/0159265 A1 6/2009 Freyer
2009/0255690 A1 * 10/2009 Conner ..... E21B 33/1216 166/387
2009/0277648 A1 11/2009 Nutley et al.
2009/0283254 A1 * 11/2009 Andersen ..... E21B 17/023 166/118
2009/0308592 A1 * 12/2009 Mercer ..... E21B 33/12 166/134
2010/0038074 A1 * 2/2010 Patel ..... E21B 33/1216 166/187
2010/0186970 A1 7/2010 Burnett
2010/0276137 A1 * 11/2010 Nutley ..... E21B 33/1216 166/185
2010/0294485 A1 11/2010 Lynde et al.
2011/0037229 A1 2/2011 Clarke
2011/0101615 A1 * 5/2011 Clarke ..... E21B 33/128 277/336
2011/0297368 A1 12/2011 Lembcke
2012/0018143 A1 1/2012 Lembcke
2012/0037355 A1 * 2/2012 Bishop ..... E21B 33/128 166/119
2012/0073830 A1 3/2012 Lembcke et al.
2012/0133098 A1 * 5/2012 Farquhar ..... E21B 33/1216 277/314
2012/0145412 A1 6/2012 Andersen et al.
2012/0217025 A1 * 8/2012 Shkurti ..... E21B 33/1216 166/387
2012/0305236 A1 12/2012 Gouthaman
2013/0147120 A1 6/2013 O'Malley
2013/0213672 A1 8/2013 Nutley et al.
2013/0306330 A1 11/2013 Bishop et al.
2013/0306331 A1 * 11/2013 Bishop ..... E21B 33/128 166/387
2014/0034335 A1 2/2014 Nutley et al.
2014/0262351 A1 9/2014 Derby
2014/0265161 A1 9/2014 Sutterfield et al.
2014/0290946 A1 10/2014 Nguyen et al.
2015/0101796 A1 4/2015 Davies et al.
2015/0115539 A1 4/2015 Guenther et al.
2015/0308214 A1 10/2015 Bilansky et al.
2015/0330174 A1 11/2015 Craigon et al.
2015/0354313 A1 12/2015 McClinton et al.
2016/0109025 A1 4/2016 McCarrey et al.
2016/0208632 A1 7/2016 Davis et al.
2016/0369586 A1 12/2016 Morehead et al.
2016/0376869 A1 12/2016 Rochen et al.
2017/0191340 A1 7/2017 Dent et al.
2017/0342797 A1 * 11/2017 Murphree ..... E21B 33/1208
2018/0010418 A1 1/2018 Vanlue
2018/0023366 A1 1/2018 Deng et al.
2018/0106125 A1 4/2018 Deng et al.
2018/0298716 A1 10/2018 Cayson et al.
2018/0298718 A1 10/2018 Cayson et al.
2018/0320473 A1 11/2018 Xu et al.
2019/0017347 A1 1/2019 Kendall et al.
2019/0040710 A1 2/2019 Deng et al.
2019/0078413 A1 3/2019 Kendall et al.
2019/0120011 A1 4/2019 Kellner
2019/0169951 A1 6/2019 Frazier
2019/0249511 A1 8/2019 Deng et al.
2019/0352997 A1 * 11/2019 Brown ..... E21B 33/128
2019/0368304 A1 12/2019 Deng et al.

FOREIGN PATENT DOCUMENTS

WO 2006046075 A2 5/2006
WO 2006121340 A1 11/2006
WO 2009074785 A2 6/2009
WO 2013128222 A1 9/2013

OTHER PUBLICATIONS

Notification of Transmittal of the International Search Report and the Written Opinion of the International Searching Authority, or the Declaration; PCT/US2018/027359; dated Aug. 1, 2018; 11 pages.

(56) References Cited

OTHER PUBLICATIONS

Notification of Transmittal of the International Search Report and the Written Opinion of the International Searching Authority, or the Declaration; PCT/US2018/041880; dated Nov. 21, 2018; 13 pages.
Notification of Transmittal of the International Search Report and the Written Opinion of the International Searching Authority, or the Declaration; PCT/US2020/019872; dated Jun. 19, 2020; 13 pages.

* cited by examiner

MULTI-LAYER PACKER BACKUP RING WITH CLOSED EXTRUSION GAPS

CROSS REFERENCE TO RELATED APPLICATION

This application is a continuation of and claims priority to U.S. application Ser. No. 15/701,015 filed Sep. 11, 2017, the disclosure of which is incorporated by reference herein in its entirety.

FIELD OF THE INVENTION

The field of the invention is sealing systems for subterranean tools against tubular or open hole or cased hole and more particularly anti-extrusion barriers for low, medium and extended reach for a seal element.

BACKGROUND OF THE INVENTION

In the unconventional drilling and completion industry, oil and gas deposits are often produced from tight reservoir formations through the use of fracturing and frack packing methods. To frack a well involves the high pressure and high velocity introduction of water and particulate media, typically a sand or proppant, into the near wellbore to create flow paths or conduits for the trapped deposits to flow to surface, the sand or proppant holding the earthen conduits open. Often, wells have multiples of these production zones. Within each production zone it is often desirable to have multiple frack zones. For these operations, it is necessary to provide a seal known as a frack packer, between the outer surface of a tubular string and the surrounding casing or borehole wall, below the zone being fractured, to prevent the pumped fluid and proppant from travelling further down the borehole into other production zones. Therefore, there is a need for multiple packers to provide isolation both above and below the multiple frack zones.

A packer typically consists of a cylindrical elastomeric element that is compressed axially, or set, from one end or both by gages within a backup system that cause the elastomer to expand radially and form a seal in the annular space. Gages are compressed axially with various setting mechanisms, including mechanical tools from surface, hydraulic pistons, atmospheric chambers, etc. Setting typically requires a fixed end for the gages to push against. These fixed ends are often permanent features of a mandrel but can include a dynamic backup system. When compressed, the elastomeric seal has a tendency to extrude past the gages. Therefore, anti-extrusion backups have become common in the art. However, typical elastomeric seals maintain the tendency to extrude through even the smallest gaps in an anti-extrusion backup system.

In cased-hole applications, anchoring of compression set packers is a common feature in the completion architecture. Anchoring is provided by wedge-shaped slips with teeth that ride up ramps or cones and bite into the casing before a packer is set. These systems are not part of the backup system nor are they designed to provide anti-extrusion. Often they are used in the setting of the packer to center the assembly which lowers the amount of axial force needed to fully set the elastomer seal. Once set, anchoring systems are also useful for the life of the packer to provide a uniform extrusion gap, maintain location and help support the weight of a bottom-hole assembly in the case of coiled tubing frack jobs. Anchors also prevent tube movement in jointed strings resulting from the cooling of the string by the frack fluid. Movement of the packers can cause them to leak and lose seal.

In open-hole frack pack applications it is rarer for the packer to have anchoring mechanisms, as the anchor teeth create point load locations that can overstress the formation, causing localized flow paths around the packer through the near well-bore. However, without anchors, movement from the base pipe tubing can further energize the elastomeric seal. Energizing the seal from tube movement tends to overstress the near wellbore as well, leading to additional overstressing of the wellbore, allowing communication around the packer, loss of production, and potential loss of well control to surface. However, the art of anchoring has been reintroduced in new reservoirs in deep-water open-hole fracking operations. The current state of the art in open-hole frack pack operations requires a choice between losing sealing due to anchor contact induced fractures, packer movement, or over-energizing of the elastomeric element.

Extrusion barriers involving tapers to urge their movement to block an extrusion path for a sealing element have been in use for a long time as evidenced by U.S. Pat. No. 4,204,690. Some designs have employed tapered surfaces to urge the anti-extrusion ring into position by wedging them outwardly as in U.S. Pat. No. 6,598,672 or in some cases inwardly as in U.S. Pat. No. 8,701,787. Other designs simply wrap thin metal rings at the extremities of the sealing element that are designed to contact the surrounding tubular to create the anti-extrusion barrier. Some examples of these designs are U.S. Pat. Nos. 8,479,809; 7,708,080; US 2012/0018143 and US 2013/0147120. Of more general interest in the area of extrusion barriers are U.S. Pat. No. 9,140,094 and WO 2013/128222.

In some applications the gap across which the seal is expected to function is quite large placing such applications beyond the limits of the design in U.S. Pat. No. 6,598,672. There is a need for an extended reach design that can withstand the pressure differentials. The present invention addresses this need with slots that extend toward each other from opposing faces and are circumferentially offset. The slots are connected at voids that extend from the original inside to the original outside diameter. Expansion of the ring allows alternating voids to shear at the outside and the inside diameter so that as gaps form in the ring a segment of the ring presents itself in each of the opened gaps as both the inside and the outside diameters increase. In an alternative solution to extrusion through a backup ring a backup ring with a common base has multiple rows of extending segments with gaps in one row offset circumferentially with gaps in an adjacent row. The gaps are held by a breakable member that shears or is otherwise removed when the set is complete. Alternatively or additionally overlapping layers can be held together for running in only to release in the set position. This allows for faster running in rates and reduced deformation from residual stresses which are part of an additive manufacturing production method for the overlapping layers. The common base lends structural integrity to the backup ring design and reduces the risk that relative rotation can occur between adjacent rows that would tend to align the offset gaps from one row to the next. These and other aspects of the present invention will be more readily apparent to those skilled in the art from a review of the description of the preferred embodiment and the associated drawings while understanding that the full scope of the invention is to be determined from the appended claims.

SUMMARY OF THE INVENTION

An extrusion ring has a base from which multiple segmented rows of rings integrally extend. Gaps in one row are offset from the adjacent row to cover any gaps. The rows gain strength from a common base that also prevents relative rotation among the rows. The overlapping rings are additively manufactured with breakable restraints in some or all the gaps that fail during the setting such as in shear. Faster running in rates can be realized as each ring row has hoop strength due to the ties in the gap or gaps that are incorporated into the additive manufacturing process to make the assembly. Residual stresses in each ring from the additive manufacturing process are resisted from the ties in the gaps. Ties between overlapping rows are also contemplated.

DETAILED DESCRIPTION OF THE, PREFERRED EMBODIMENT

Figure 4:
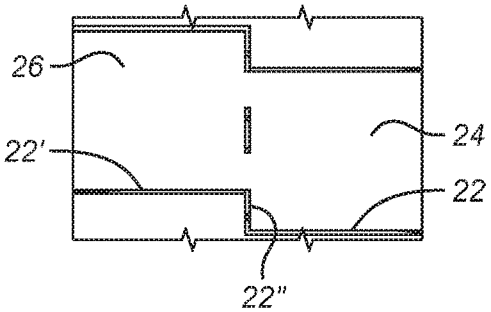
FIG. 4 is the view along line 4-4 of FIG. 2.
Figure 2:
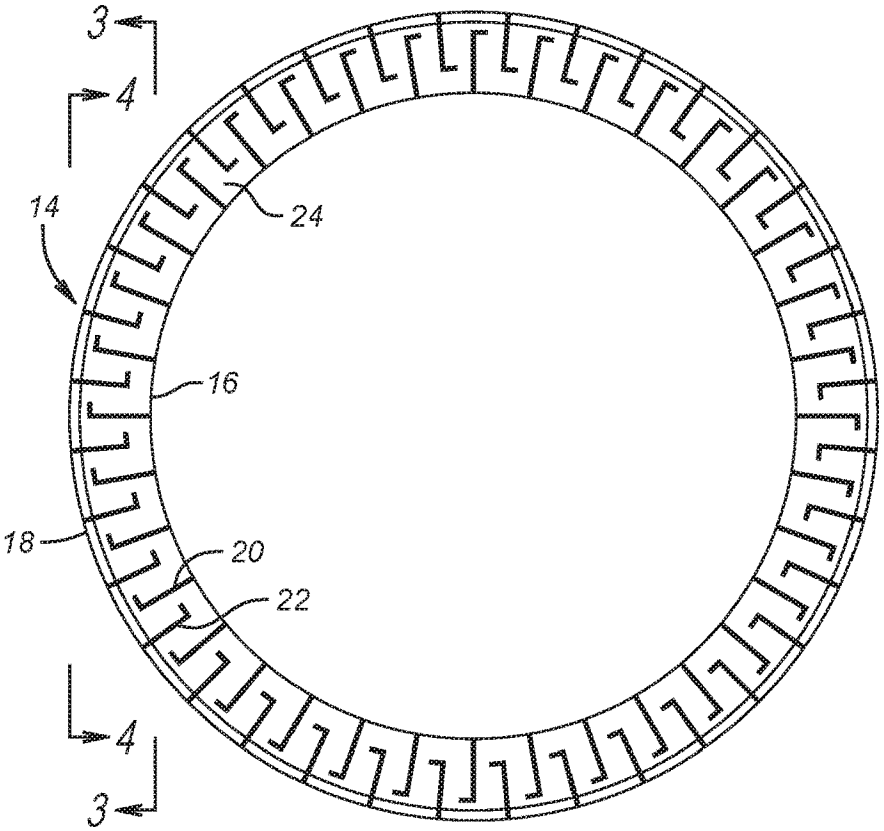
FIG. 2 is a side view of the ring of FIG. 1.
Figure 1:
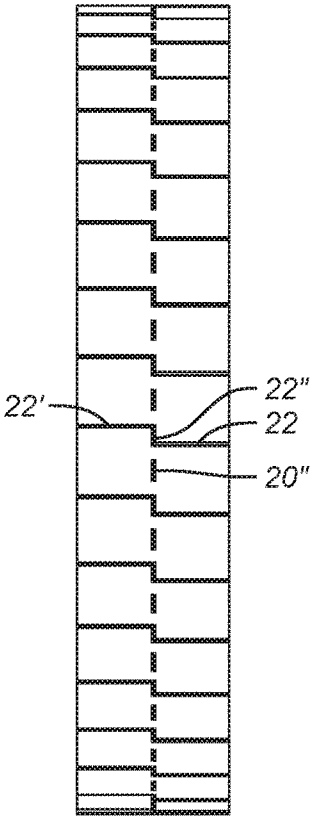
FIG. 1 is a front view of a backup ring in a run in position.
Figure 5:
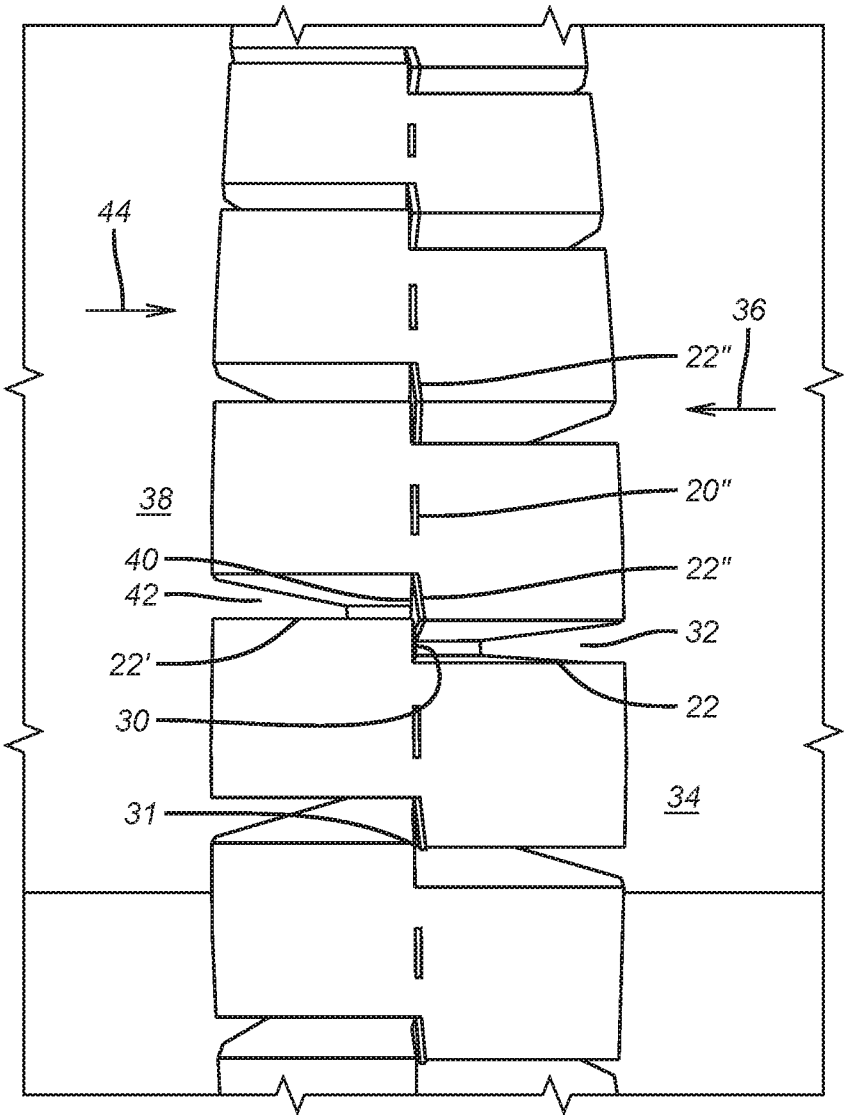
FIG. 5 is an outside diameter view of the backup ring in an expanded position.
Figure 10:
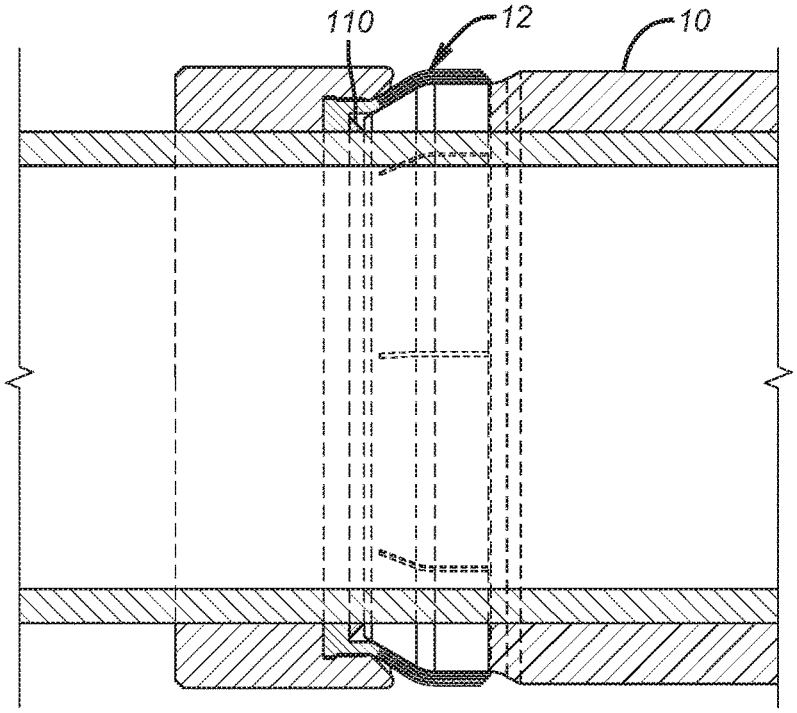
FIG. 10 is a section view of the backup ring of FIG. 8 in a run in position.
Figure 11:
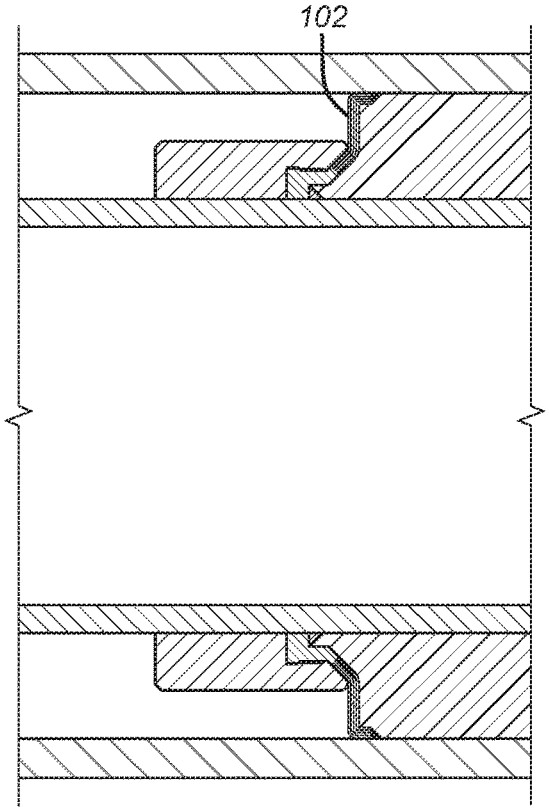
FIG. 11 is the view of FIG. 10 in the set position.

FIGS. 10 and 11 illustrate the juxtaposition of a sealing element 10 next to a backup ring 12. FIG. 2 shows an end view of a continuous single ring 14 that can be disposed next to a sealing element 10. Ring 14 has an inside diameter 16 and an outside diameter 18. There are alternating l-shaped slots 20 and 22 that start at the outside diameter 18 and at the inside diameter 16. FIG. 2 shows a tapered or sloping side 24 and slots 20 and 22 that alternate as to the location of the long dimension of the l-shaped slot. Sloping side 26 is not seen in FIG. 2 but is shown as FIG. 3 as well as the cylindrically shaped inside surface 28 that defines the inside diameter 16. FIGS. 1 and 4 both show an outside view where it is seen that slot 22 is a segment that goes to outside diameter 18 has a continuation slot segment 22' that is circumferentially offset a few degrees. Slots 22 and 22' are at opposed ends of an oblong bore 22" that may have internal supports. Bore or opening 22" is seen at an opposite end at inside diameter 16 in FIG. 3. When ring 14 is increased in both inside diameter 16 and outside diameter 18 the bore undergoes hoop stress and comes apart at outside diameter 18 when outside diameter 18 grows as shown in FIG. 5. The connecting bore 22" has sheared leaving surface 30 as a closing wall to a gap 32 that opens and into which the sealing element 34 can move. However, since the gap 32 is closed by surface 30, migration of the sealing element 32 in the direction of arrow 36 is stopped by surface 30. At the same time should there be a sealing element 38 on an opposite side of ring 14, the searing apart of bore 22" at the outside diameter 18 also leaves surface 40 at the end of gap 42 to stop movement of seal 38 in the direction of arrow 44.

Figure 3:
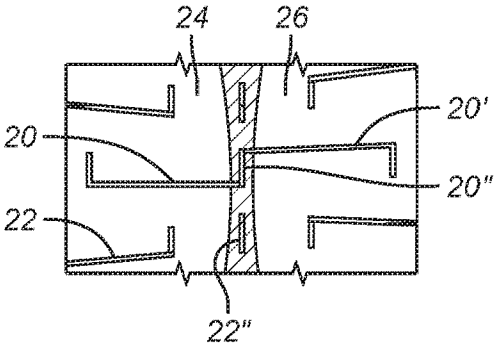
FIG. 3 is the view along line 3-3 of FIG. 2.
Figure 6:
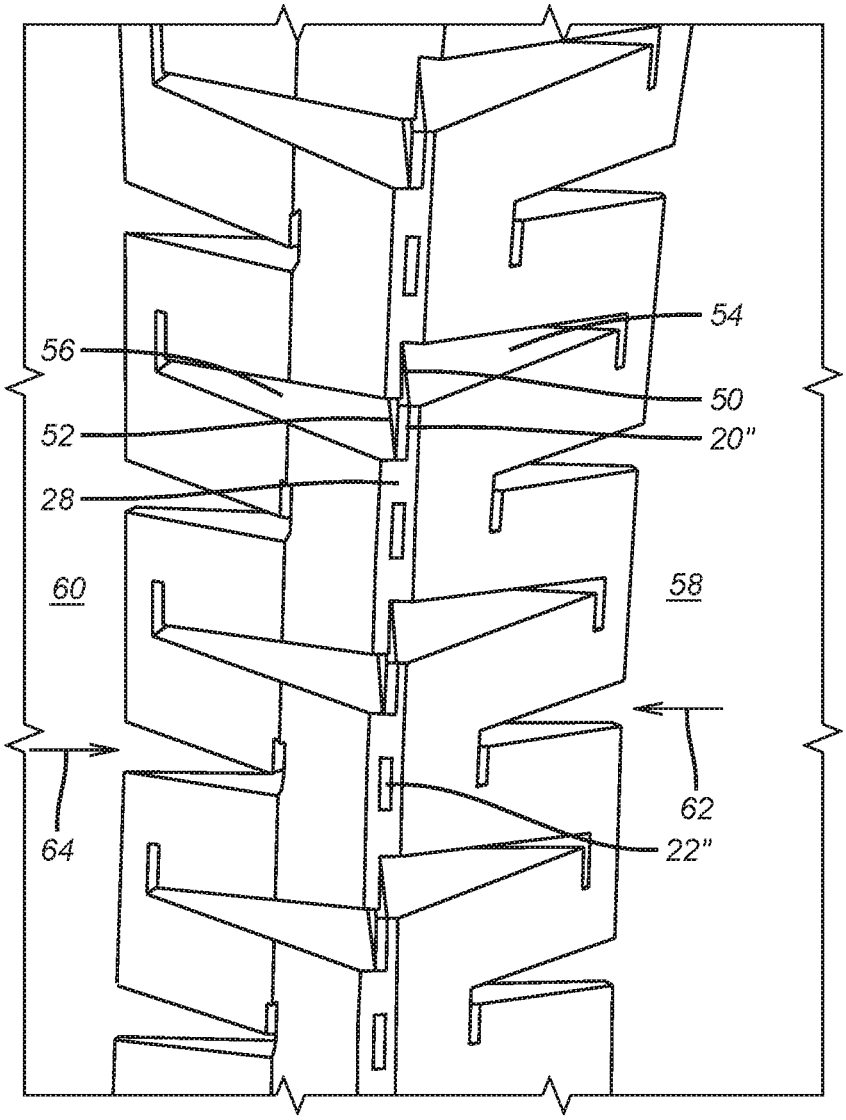
FIG. 6 is an inside diameter view of the backup ring in the expanded position.

Bores 20" are seen as alternating with bores 22" at the outside diameter 18 as seen in FIG. 1 and are seen at inside diameter 16 in FIG. 3 as connecting slots 20 and 20' in the run in condition. FIG. 6 shows bores 20" sheared from hoop stress during radial expansion of inside diameter 16. Surfaces 50 and 52 are presented respectively at the ends of widened slots 54 and 56 from the inside diameter 16 radial expansion. As a result, a sealing element 58 will be blocked from passing surface 50 in the direction of arrow 62 or/and a sealing element 60 will be blocked by surface 52 when moving in the direction of arrow 64 under differential pressure that would otherwise allowed for extrusion in gaps closed at the inside diameter by surfaces 50 and 52 as a result of shearing of bores or openings 20" at inside dimension 28. Note that at inside dimension 28 bores 22" do not shear as they are supported at that location by the ring structure unlike bores 20" that span slots 20 and 20' at inside dimension 28.

Note that as shown in FIG. 6 opposed surfaces 50 and 54 may separate circumferentially to leave a small gap or their ends can alternatively align or overlap and may also optionally involve a stop or overlap to limit the relative circumferential movement between surfaces such as 50 and 54 at inside surface 28 to insure that any gap such as 54 and 56 are fully closed at maximum condition for inside diameter 16. This is equally true at outside diameter 18 shown in FIG. 5 where surfaces 30 and 40 circumferentially separate to an end position where there is overlap between them, a small gap or alignment between their ends so that there is no effective gap in the directions of arrows 36 and 44. Alternatively opposed surfaces 30 and 40 can have one or move travel stops 31 to limit the amount of relative circumferential movement to an overlapping position as shown in FIG. 5.

Figure 7:
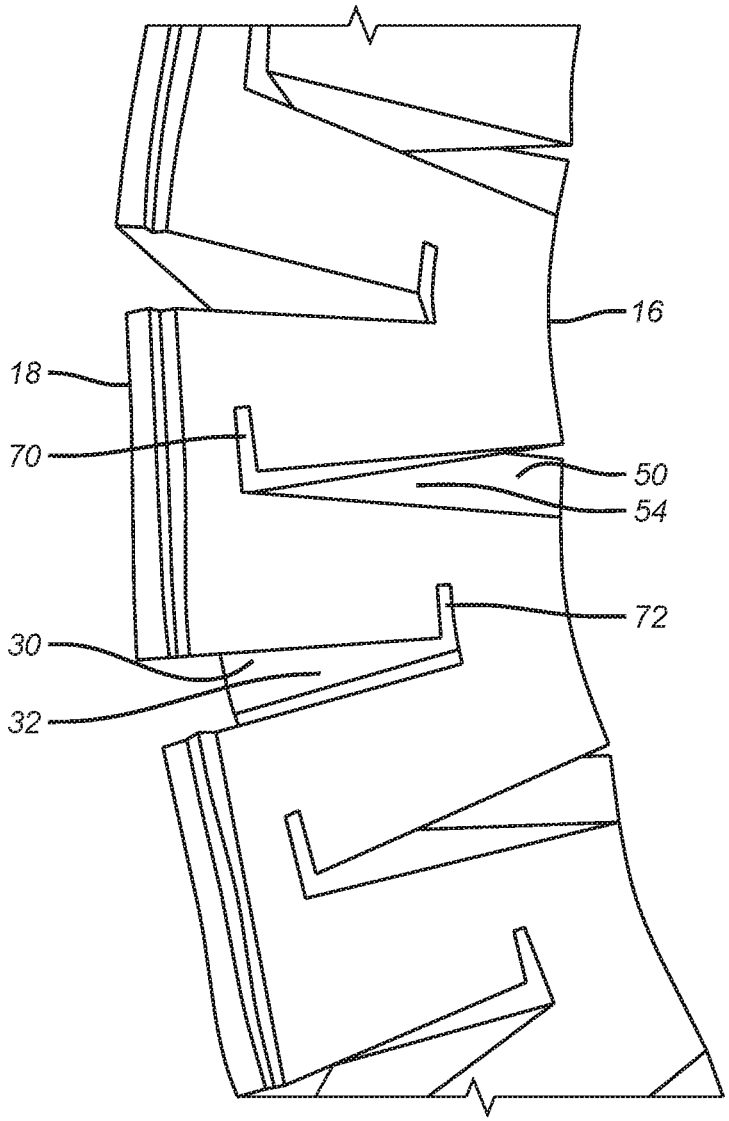
FIG. 7 is a side view of the backup ring in the expanded position.

FIG. 7 shows how surfaces 30 and 50 close off gaps 32 and 54 respectively when in the inside diameter 16 and the outside diameter 18 are increased. It also shows the short slot segments that make the l-shape 70 and 72 that are there to reduce stress concentration at ends of opening gaps such as 32 and 54, for example.

Figure 13:
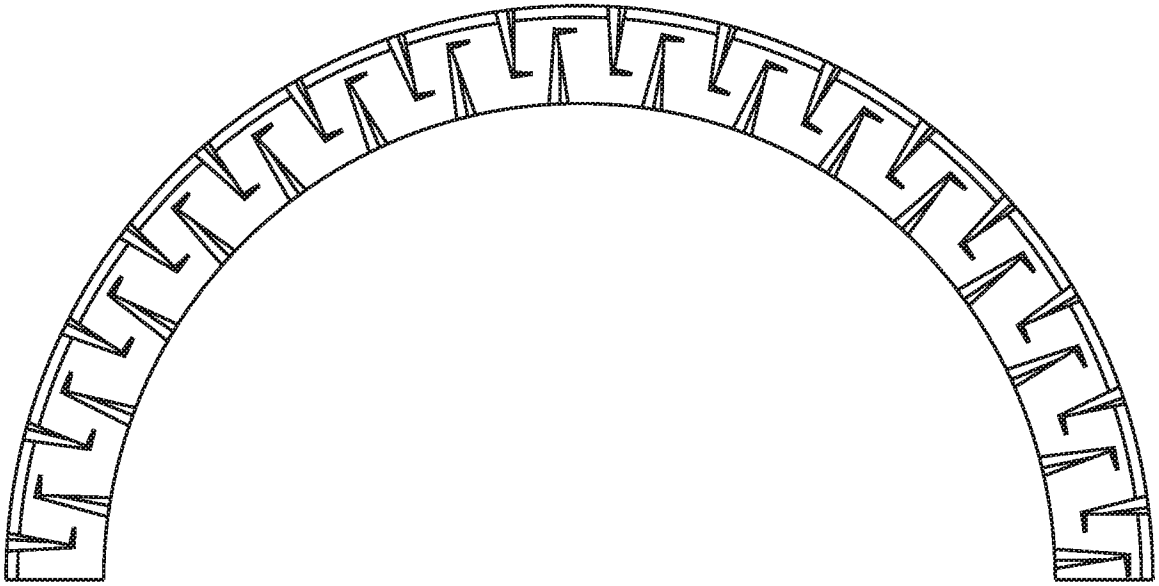
FIG. 13 is an expanded view of the view in FIG. 2.
Figure 12:
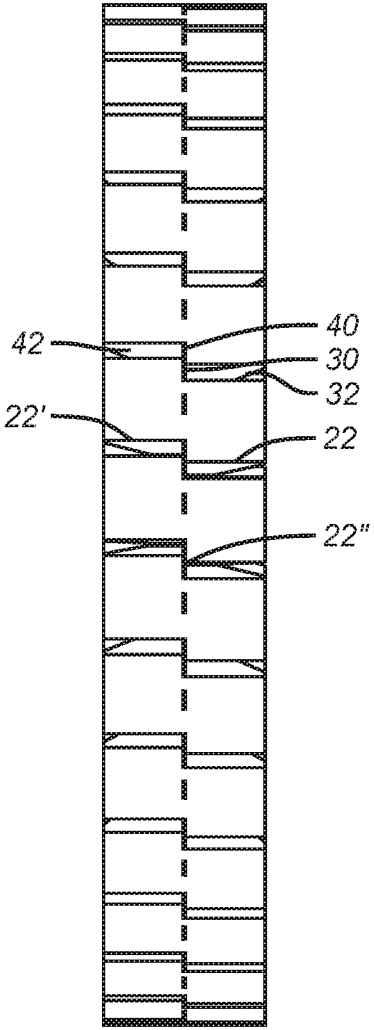
FIG. 12 is an expanded view of the view on FIG. 1.

FIG. 12 is similar to FIG. 5 and represents the gaps closed with end walls 30 and 40 after the inside and outside diameters are enlarged, as previously described. FIG. 13 is the view of FIG. 2 after the inside and outside diameters are enlarged graphically illustrating the alternating pattern of opened gaps on the inside diameter and the outside diameter with the extrusion gaps closed using a single ring that can grow in outside diameter, for example from 8.3 inches to 9.875 inches while closing extrusion paths.

Figure 17:
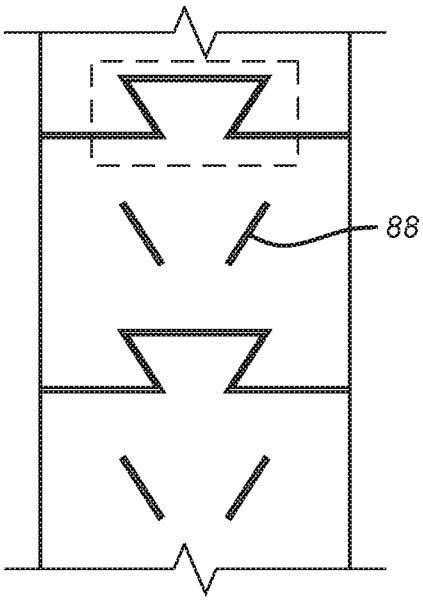
FIG. 17 is an alternative to the dog leg slot design in FIG. 1 using a dovetail configured to allow relative circumferential movement for an increase in diameter.
Figure 18:
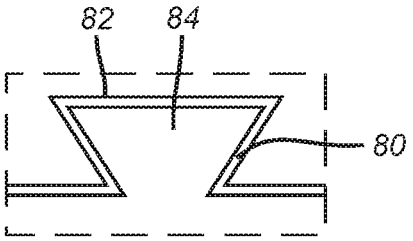
FIG. 18 is a close up view of FIG. 17 to show the dovetail has initial gaps to allow for the relative circumferential movement at the inside and the outside diameters.
Figure 19:
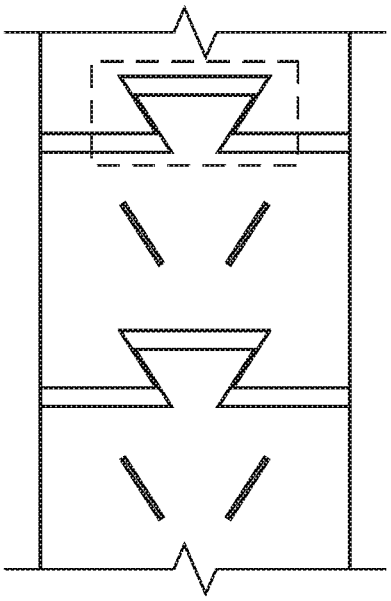
FIG. 19 is the view of FIG. 17 after the diameters are increased.
Figure 20:
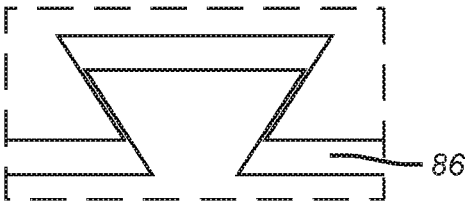
FIG. 20 is an enlarged view of FIG. 19 showing the dovetail acting as a relative circumferential movement travel stop and gap barrier at the same time.

FIGS. 17-20 are an alternative design using the concepts of the design in FIGS. 1-7 but instead of l-shaped slots with a dog leg that starts out as a bore but then shears to create relative circumferential movement to produce end walls to close gaps that enlarge at the inside and the outside diameters, uses slots that are interacting dovetail shapes that alternatively start at the inside diameter and the outside diameter and do not go all the way through. Diameter enlargement at the inside and the outside diameters is enabled in a relative circumferential direction until one part of the dovetail closes an initial dovetail gap. The dovetail limits the ring gaps and acts as an extrusion barrier by its presence in those enlarging gaps that open alternatingly from the inside and outside diameters. FIGS. 17 and 18 show the initial gaps 80 between the male 82 and the female 84 components of each dovetail. FIG. 20 shows gap 80 closed during diameter expansion at the inside and the outside diameters. An extrusion gap such as 86 opens but the male component 84 is in that gap to close it up. The same condition happens at the inside dimension and the outer dimension of the backup ring as previously described in the context of FIGS. 1-7. Bores 88 do not open on the outside diameter as between FIGS. 17 and 19 but on the inside diameter that is not shown for this variation there is relative circumferential movement until the counterpart dovetail on the inside diameter closes an initial dovetail gap that defines the end of relative circumferential movement where gaps open on the inside dimension. In the sense of alternating gaps that open from the inside and then the outside diameters the embodiments of FIGS. 1-7 and 17-20 operate the same way. Instead of bores shearing to enable circumferential growth the slack in dovetails closed to enable circumferential growth at the inside and the outside diameters. FIGS. 17-20 are schematic and can illustrate the view at an outer diameter or an inner diameter. The operating principle is the same as previously described for FIGS. 1-7 in that gaps alternatingly open up in a circumferentially offset manner on the inside and the outside dimensions and the gaps so created are then closed to seal element extrusion. In the case of FIGS. 1-7 a wall surface is interposed in the gap due to the alternating gaps opening up and in FIGS. 17-20 the dovetail itself allows the gaps to open up until slack in the dovetail is removed at which time the male portion of the dovetail is interposed in the gap to block it entirely or at least substantially.

Figure 14:
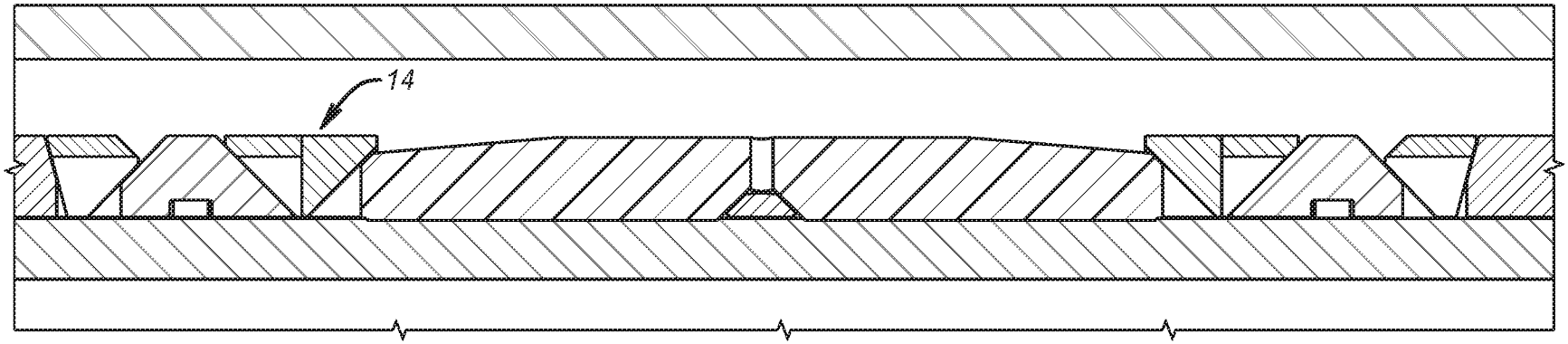
FIG. 14 is a section view of a packer in the run in position using the backup ring.
Figure 16:
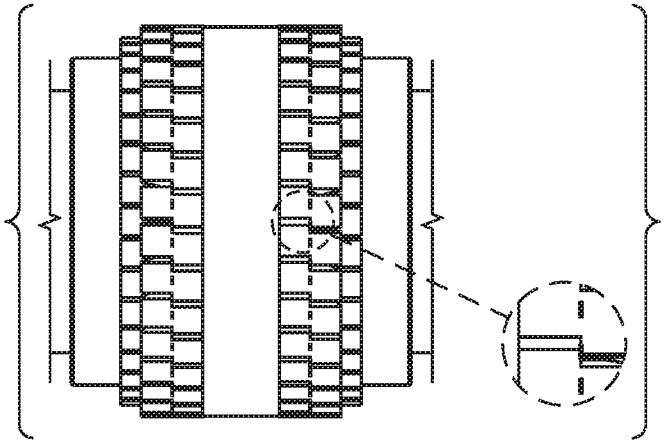
FIG. 16 is an exterior view of the view in FIG. 15.
Figure 15:
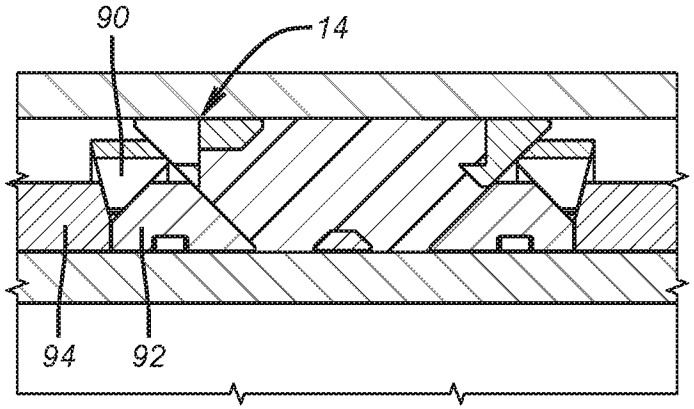
FIG. 15 is a set position of the view in FIG. 14.

FIGS. 14-16 show a typical packer in the run in and set positions using the ring 14 as a backup ring. FIG. 16 graphically shows how the dog leg slots that open on the outside diameter block the extrusion of the sealing element as previously described. Details of the operation of the rings 90, 92 and 94 can be reviewed in U.S. application Ser. No. 14/989,199 that is fully incorporated herein as if fully set forth. While that design featured alternating gaps opening on the inside diameter and the outside diameter, there was no feature of blocking the opened gaps against extrusion.

Figure 8:
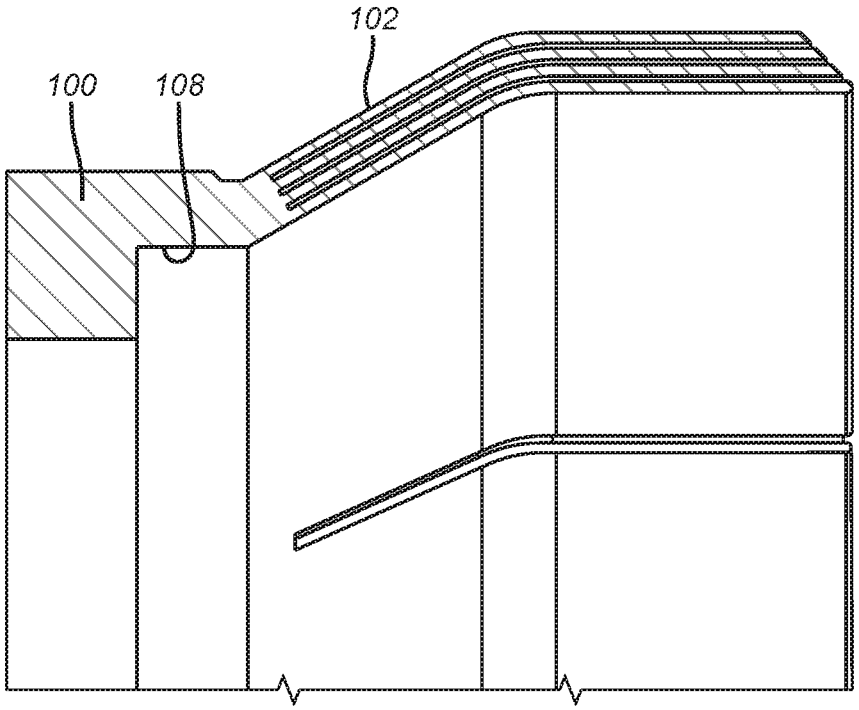
FIG. 8 is a section view of a backup ring showing the layers of ring segments extending from a common base.

FIG. 8 illustrates a backup ring design featuring a common base ring 100 that has multiple segmented rings 102 integrally extending therefrom, with 2-4 being preferred. The segmented nature of each ring can be seen in FIG. 9 in the form of offset gaps 104 and 106 in adjacent rings. Preferably there is a circumferential offset of about 12 degrees between gaps on adjacent rings. Each ring has multiple gaps that are all offset from gaps on an adjacent ring on either side. Because the segments that make up each ring are integrally connected to the base ring 100 there is no relative rotation among the stacked segmented rings 102 and the rings 102 are still flexible as seen by comparing FIGS. 10 and 11 for the run in and the set positions. Since the stacked rings 102 are supported circumferentially along the length of each ring segment from base 100 the assembly of rings also has greater resistance to extrusion when pushed against the surrounding tubular as shown in FIG. 11. Ring segments 102 extend to different or the same axial lengths for running in and have a free end that is offset and axially aligned with an axis of ring 100. Gaps 104 are as long axially as said segments 102 or shorter. An internal groove 108 holds a mandrel seal 110 to prevent extrusion of sealing element 10 along the mandrel.

Figure 9:
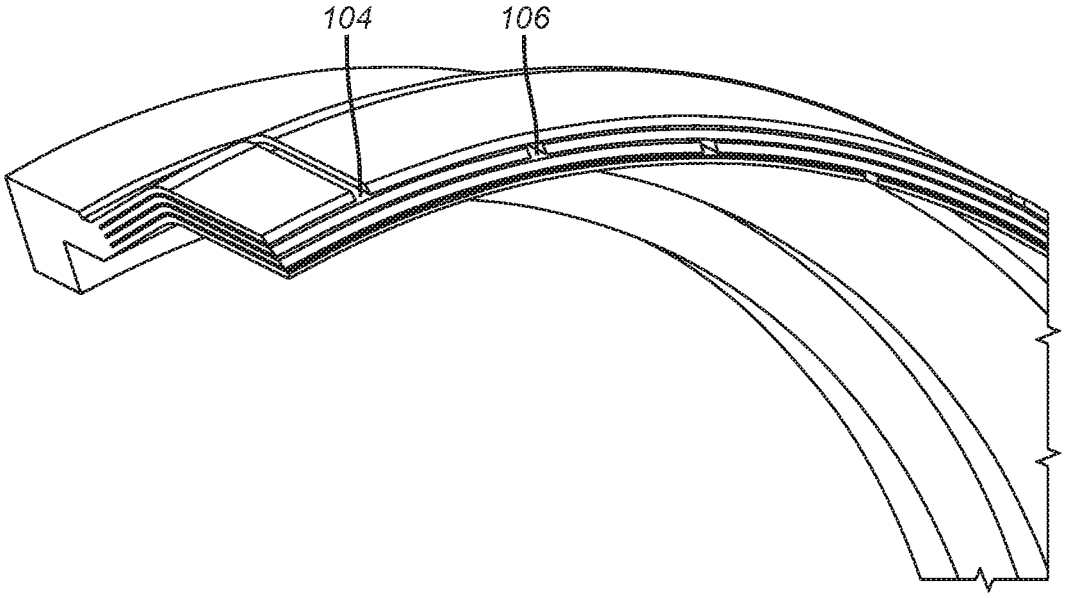
FIG. 9 is an isometric view of the backup ring of FIG. 8
Figure 21:
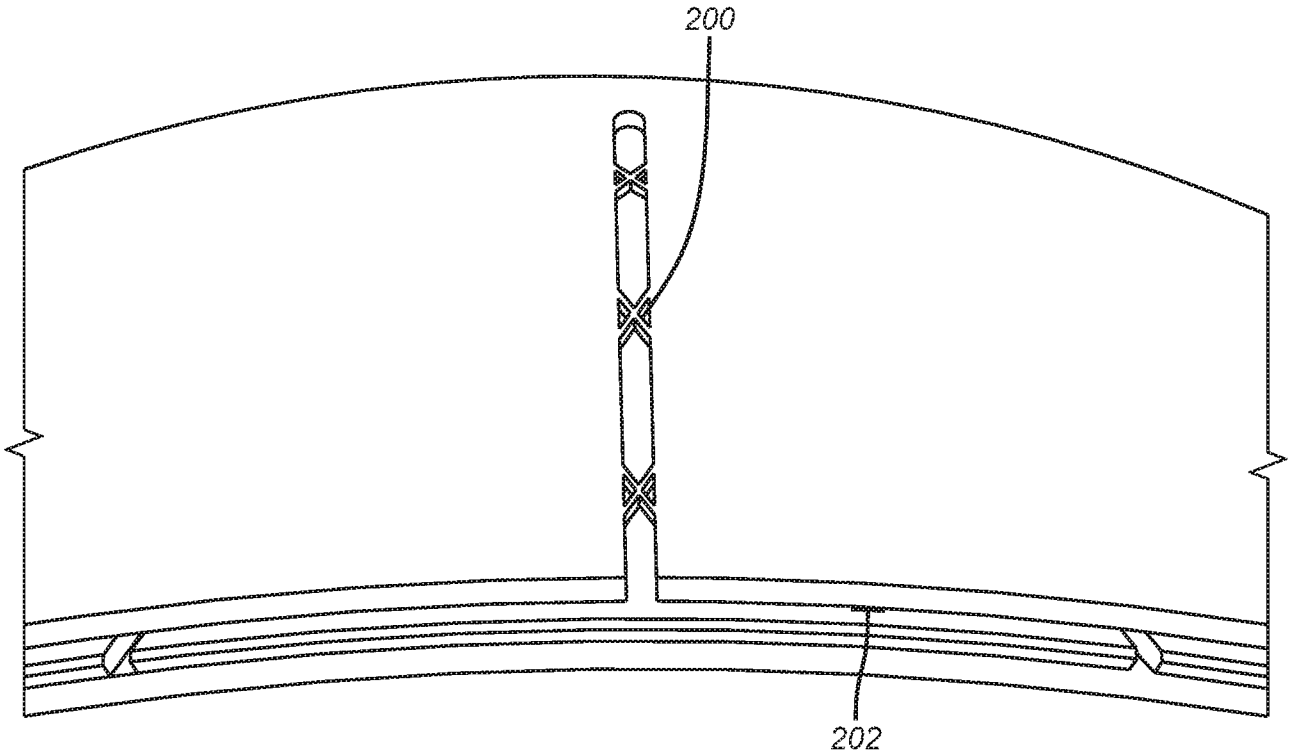
FIG. 21 is a modified version of FIG. 9 showing the use of removable ties in the gap or gaps in a given ring or between adjacent rings.

FIG. 21 shows ties 200 in one or more gaps 104 on one or more ring segments 102. The preferred ties 200 are shown in an X shape although other shapes are contemplated such as straight line(s), rounded shapes, quadrilateral or multilateral shapes. The material of the ties 200 or 202 is preferably the same as the segments 102 that define the rings. In a single gap 104 there can be a single or multiple ties 200 that are axially spaced as shown in FIG. 21. The presence of ties 200 provides several operational benefits. The packer can be run in the hole faster since the presence of the ties 200 in the gaps 104 gives each ring made of segments 102 a greater hoop strength against the force generated from relative movement of the ring made of segments 102 with respect to the surrounding well fluid. Another advantage is that the ties 200 resist residual stresses from the additive manufacturing process used to make the backup ring assembly shown in FIGS. 9 and 21. The residual stresses from that process could result in warping of parts of ring made of segments 102 between gaps such as 104 or 106. Ties 202 are schematically illustrated as between adjacent rings made of segments 102. Ties 202 can be used to provide greater strength between layers so they can act as a cohesive structure until the ties are broken during a setting of the packer. In essence the ties 202 can be distributed in a predetermined or random pattern and act as temporary support structures between pairs of rows of ring segments 102 that can fail preferably in shear when the packer is set. Although shown schematically between a single abutting pair of rows of ring segments 102, the ties can be present between multiple pairs of rows of ring segments 102. Ties 202 and be used exclusively as can ties 200 or a combination of those two types of ties can be combined in a single FIG. 9 structure. Their use reduces swabbing tendency of the backup ring during running in by incrementally strengthening the FIG. 9 structure against the fluid force generated from relative movement of the packer assembly being run in. Since the backup ring of FIG. 9 is made using the additive manufacturing process, the material of the rings of segments 102 and the ties 200 or 202 is preferably the same. The preferred mode of tie failure is in shear, although other failure modes and material dissimilarities between rings of segments 102 and ties 200 or 202 are contemplated. In those events tie failure can be caused by disintegration, degradation, chemical reaction or even shape change using shape memory material. An alternative operating mode encompasses stretch of ties 200 or 202 without actual failure. The ties can elastically or plastically deform without shear for example and still provide the added strength to assist in rapid deployment or to counteract residual stress from the additive manufacturing process.

Those skilled in the art will appreciate that alternative backup ring designs are described that have the objective of dimensional growth while limiting or eliminating extrusion of a sealing element on preferably opposed ends of a sealing element. In FIGS. 1-7 alternating circumferential slots with dog leg connectors in the form of a bore extend from the inside diameter and the outside diameter in alternating fashion. On radial expansion the bores shear on surfaces where the bore is a connector to slots that extend from opposed ends of an outer or inner diameter and where the two slots are themselves circumferentially offset by the width of the oblong bore or void. As a result the inside and outside diameters grow as the slots part to form gaps and the offset disposition of slots connected by an oblong bore allows an end surface to be positioned in each gap that minimizes or completely prevents seal element extrusion. The dimensional growth need not be uniform so that the enlarged dimension can conform to an irregularly shaped borehole wall, for example. The adjacent and oppositely facing end walls can interact with each other as a given oblong opening is sheared to expose such end walls so that there is overlap between such adjacent end walls with a stop device that limits relative circumferential movement between them. Alternatively the wall ends can align or pull away from each other slightly so that there is either no extrusion gap or a minimal gap for the sealing element.

The same pattern of slots that open into gaps alternating on the inside and outside diameters can be used with dovetail cuts that have slack in them in the run in diameter and where the relative circumferential movement of each pair of dovetail components is limited by the slack coming out of each dovetail connection. The gaps that open are blocked by the extension of the male of the dovetail pair extending into the opening. The dovetail pairs start in an alternating pattern on the inside and outside diameters to present a cohesive ring structure that can expand on the inside and outside diameters. The dovetail slots on the inside diameters are circumferentially spaced from the dovetail slots on the outside diameter and the gaps that form as the diameters increase are substantially blocked by the male dovetail component bottoming on the female surrounding component or when the outside dimension of the backup ring engages a surrounding tubular, whichever happens first. The structure with alternating dog leg slots or dovetail slots lets the ring remain whole while lending the ring flexibility of going out of round so that if the surrounding tubular has dimensional imperfections, the backup ring can adapt to the actual shape of the inside wall of the surrounding tubular. A single ring can be placed between sealing elements and reduce or eliminate extrusion between the sealing element in either of opposed directions.

In a backup ring with multiple stacked rows of segmented rings the gaps in adjacent rings are offset and all the rings are preferably integral to a common ring base. The extrusion gaps are closed off while the integration of the stacked rings with the base provides for a stronger yet still flexible design that can conform to the surrounding tubular wall for closing an extrusion gap. The outer edge of the stacked rings is made long enough so that there is bending into a more parallel orientation with the surrounding tubular when the set position of FIG. 11 is reached. A support ring can backstop the backup ring in the set position on an opposite side from the sealing element as shown also in FIG. 11. Ties in gaps on one or more rows can give hoop strength for faster running in without swabbing. The ties can resist residual stresses in one or more rows of rings that arise from an additive manufacturing process. Ties can also be located between rows and offset from gaps in each row. The ties can stretch or fail during setting the packer to allow the needed bending to function as an extrusion barrier. Other modes of release by the ties is also contemplated.

The above description is illustrative of the preferred embodiment and many modifications may be made by those skilled in the art without departing from the invention whose scope is to be determined from the literal and equivalent scope of the claims below:

We claim:

1. A backup ring assembly for extrusion protection for a mandrel mounted sealing element of a borehole barrier, comprising:

a ring comprising an axis and further comprising integral axially extending segments at multiple diameters with segments at each diameter forming a ring shape with gaps wherein gaps in adjacent said ring shapes being circumferentially offset;

at least one tie spanning at least one of said gaps on at least one said ring shape, the tie being a part of the structure of the at least one said ring shape that provides hoop strength to the at least one said ring shape, the gap extending beyond the tie in both axial directions.

2. The assembly of claim 1, wherein:

said at least one tie fails when the borehole barrier is set.

3. The assembly of claim 1, wherein:

said at least one tie stretches elastically or plastically when the borehole barrier is set.

4. The assembly of claim 1, wherein:

said ring shape and said at least one tie are additively manufactured.

5. The assembly of claim 4, wherein:

said at least one tie resists residual stresses that result from said additive manufacturing of said segments connected by said at least one tie.

6. The assembly of claim 1, wherein:

said at least one tie in said at least one gap comprises multiple ties in the same said at least one gap.

7. The assembly of claim 1, wherein:

said at least one tie in said at least one gap comprises at least one said tie in each said gap between said segments that define at least one said ring shape to increase resistance of said at least one ring shape to flexing during running in.

8. The assembly of claim 1, wherein:

said at least one tie relaxes or releases in response to interaction with well fluids or well temperatures.

9. A backup ring assembly for extrusion protection for a mandrel mounted sealing element of a borehole barrier, comprising:

a ring comprising an axis and further comprising integral axially extending segments at multiple diameters with segments at each diameter forming a ring shape with gaps wherein gaps in adjacent said ring shapes being circumferentially offset;

at least one tie spanning at least one of said gaps on at least one said ring shape, the tie being a part of the structure of the at least one said ring shape that provides hoop strength to the at least one said ring shape and wherein at least one tie is between adjacent said segments in different ring shapes located in an offset location from said gaps defining said adjacent segments in different ring shapes.

10. The assembly of claim 9, wherein:

said at least one tie between adjacent segments in different ring shapes fails when the borehole barrier is set.

11. The assembly of claim 9, wherein:

said at least one tie between adjacent segments in different ring shapes stretches elastically or plastically when the borehole barrier is set.

12. The assembly of claim 9, wherein:

said ring shape and said at least one tie between adjacent segments in different ring shapes are additively manufactured.

13. The assembly of claim 9, wherein:

said at least one tie comprises at least one of an X shape, a linear shape, a rounded shape, and a multilateral shape.

* * * * *